US008359962B2

(12) United States Patent
Crookston et al.

(10) Patent No.: US 8,359,962 B2
(45) Date of Patent: Jan. 29, 2013

(54) CUTTING APPARATUS

(75) Inventors: Matthew Crookston, Stow, OH (US); Walter Remen, Akron, OH (US)

(73) Assignee: AJC Tools & Equipment, Hudson, OH (US)

( * ) Notice: Subject to any disclaimer, the term of this patent is extended or adjusted under 35 U.S.C. 154(b) by 243 days.

(21) Appl. No.: 12/333,745

(22) Filed: Dec. 12, 2008

(65) Prior Publication Data

US 2009/0151535 A1 Jun. 18, 2009

Related U.S. Application Data

(60) Provisional application No. 61/013,126, filed on Dec. 12, 2007.

(51) Int. Cl.
*B26D 1/12* (2006.01)

(52) U.S. Cl. ..... 83/607; 83/698.31

(58) Field of Classification Search ..... 83/607–612, 83/698.31; D18/34.7
See application file for complete search history.

(56) References Cited

U.S. PATENT DOCUMENTS

| | | | | | |
|---|---|---|---|---|---|
| 71,668 | A | | 12/1867 | Walker | |
| RE2,899 | E | | 3/1868 | McDonald | |
| 89,183 | A | | 4/1869 | Tucker | |
| 101,220 | A | * | 3/1870 | Booth | 83/608 |
| 379,777 | A | | 3/1888 | Golding | |
| 395,728 | A | | 1/1889 | Wesel | |
| 413,522 | A | | 10/1889 | Kelsey et al. | |
| 524,638 | A | | 8/1894 | Krah | |
| 628,908 | A | * | 7/1899 | Lewis | 83/589 |
| 678,441 | A | | 7/1901 | Stevens | |
| 679,167 | A | | 7/1901 | Garding | |
| 884,219 | A | | 4/1908 | Scates | |
| 1,808,054 | A | | 6/1931 | Meese | |
| 1,918,104 | A | * | 7/1933 | Hook | 83/607 |
| 2,283,569 | A | | 5/1942 | Pedersen | |
| 2,460,842 | A | * | 2/1949 | Murphy et al. | 83/379 |
| 2,573,767 | A | | 11/1951 | Jensen et al. | |
| 2,588,999 | A | | 3/1952 | Tucker | |
| 2,591,472 | A | * | 4/1952 | Segal | 83/607 |
| 3,089,373 | A | * | 5/1963 | Fischer et al. | 83/607 |
| 3,134,285 | A | * | 5/1964 | Greene | 83/607 |
| 3,799,029 | A | * | 3/1974 | Cole et al. | 83/861 |
| 4,130,037 | A | | 12/1978 | Matthews | |
| 4,198,888 | A | | 4/1980 | Gatt | |
| 4,398,441 | A | * | 8/1983 | Jue | 83/607 |
| 4,438,673 | A | * | 3/1984 | Noffke et al. | 83/502 |
| 4,498,360 | A | * | 2/1985 | Milum | 30/283 |
| 4,527,455 | A | * | 7/1985 | Morax | 83/588 |
| 4,951,540 | A | | 8/1990 | Cross et al. | |
| 4,957,025 | A | | 9/1990 | Beno | |
| 4,957,235 | A | | 9/1990 | Beno et al. | |
| 5,052,256 | A | | 10/1991 | Morrissey | |
| 5,233,894 | A | | 8/1993 | Puett | |
| 5,249,495 | A | | 10/1993 | Renk | |
| 5,392,677 | A | | 2/1995 | Sevart et al. | |
| 5,758,557 | A | * | 6/1998 | Moreton | 83/36 |
| 5,787,781 | A | | 8/1998 | Hile | |
| 5,988,027 | A | * | 11/1999 | Lenox | 83/13 |
| 5,996,461 | A | | 12/1999 | Croft | |
| 6,112,413 | A | | 9/2000 | Frakes et al. | |

(Continued)

*Primary Examiner* — Stephen Choi
(74) *Attorney, Agent, or Firm* — Hahn Loeser & Parks LLP

(57) ABSTRACT

A cutting apparatus comprises a frame assembly which includes a support surface and a first cutting blade, and at least one key hole. The cutting apparatus also comprises a cutting arm assembly which is rotatably attached to the frame assembly and includes a second cutting blade. The cutting apparatus also comprises an alignment mechanism secured to the frame assembly and the cutting arm assembly.

17 Claims, 10 Drawing Sheets

U.S. PATENT DOCUMENTS

| | | | |
|---|---|---|---|
| 6,122,891 | A | 9/2000 | Carpenter |
| 6,386,082 | B2 | 5/2002 | Lee |
| 6,412,382 | B1 | 7/2002 | Conley |
| 6,434,909 | B1 | 8/2002 | Carpenter |
| 6,595,093 | B1 | 7/2003 | Artigas |
| 6,973,725 | B2 | 12/2005 | Lai |

* cited by examiner

CUTTING APPARATUS

CROSS-REFERENCE TO RELATED APPLICATIONS

This patent application claims the benefit of U.S. Provisional Patent Application No. 61/013,126, filed Dec. 12, 2007, the disclosure of which is expressly incorporated by reference herein.

TECHNICAL FIELD

The subject invention relates to building construction equipment, and more particularly to a portable apparatus for cutting roofing shingles.

BACKGROUND OF THE INVENTION

A number of cutting apparatuses designed to shear or trim roofing shingles have been constructed and marketed, but most roofers continue to rely upon utility knives and straightedges for cutting shingles because of the ease the knives' portability and simplicity of use, as well as the ease and low cost of replacing dulled blades as compared to existing cutting apparatuses. Most existing apparatuses are cumbersome to move and provide inferior cutting results when contrasted with the utility knife. Therefore, there exists a need in the art for a portable shingle cutting apparatus which provides ease of portability and use, as well as shearing performance equivalent to or better than the cutting quality provided by utility knives.

SUMMARY OF THE INVENTION

In one embodiment, a cutting apparatus comprises a frame assembly including a support surface and a first cutting blade, wherein the support surface includes at least one key hole; a cutting arm assembly rotatably attached to the frame assembly, the cutting arm including a second cutting blade; and an alignment mechanism secured to the frame assembly and the cutting arm assembly.

In one aspect of the subject invention, the support surface is inscribed with numbers indicating angular degrees relative to the first cutting blade.

In another aspect of the subject invention, the cutting apparatus comprises a guide fence selectively attachable to the support surface through the at least one key hole, such that the position of the guide fence corresponds to an angular degree.

In still another aspect of the subject invention, the first cutting blade is selectively attachable to the frame assembly.

In a further aspect of the subject invention, the second cutting blade is selectively attachable to the cutting arm assembly.

In still a further aspect of the subject invention, the second cutting blade further comprises a blade alignment tab disposed between the cutting arm assembly and the frame assembly.

In yet another aspect of the subject invention, the cutting arm assembly comprises an arm assembly frame and an extendable handle member disposed therein.

In another aspect of the subject invention, the extendable handle member is axially reciprocating within the arm assembly frame.

In still another aspect of the subject invention, the support surface includes a handle aperture.

In a further aspect of the subject invention, the second cutting blade includes an arcuate cutting edge.

In another embodiment of the subject invention, a cutting apparatus comprises a frame assembly including a support surface and a first cutting blade; a cutting arm assembly rotatably attached to the frame assembly, the cutting arm including a second cutting blade; and an alignment mechanism secured to the frame assembly and the cutting arm assembly, wherein the alignment mechanism includes a plurality of biasing members.

In another aspect of the subject invention, the plurality of biasing members includes a first biasing member and a second biasing member.

In still another aspect of the subject invention, the first biasing member is positioned substantially perpendicular to the first cutting blade and the second biasing member is positioned substantially parallel to the first cutting blade.

In yet another aspect of the subject invention, the first biasing member and the second biasing member are arranged in different vertical planes.

In a further aspect of the subject invention, the first biasing member includes a bolt having a shaft, wherein the angle between the shaft and the first cutting blade is less than 90°.

In still a further aspect of the subject invention, the angle between the shaft and the first cutting blade is between 75° and 90°.

In yet another embodiment of the subject invention, a cutting apparatus comprises a frame assembly including a support surface and a first cutting blade, wherein the support surface includes at least one key hole; a cutting arm assembly rotatably attached to the frame assembly, the cutting arm including a second cutting blade; and an alignment mechanism secured to the frame assembly and the cutting arm assembly, wherein the alignment mechanism includes a plurality of biasing members.

In another aspect of the subject invention, a first biasing member is positioned substantially perpendicular to the first cutting blade and a second biasing member is positioned substantially parallel to the first cutting blade.

In still another aspect of the subject invention, a cutting apparatus further comprises a guide fence selectively attachable to the support surface through the at least one key hole, such that the position of the guide fence corresponds to an angle relative to the first cutting blade.

In yet another aspect of the subject invention, the second cutting blade includes an arcuate cutting edge.

DETAILED DESCRIPTION

Figure 1:
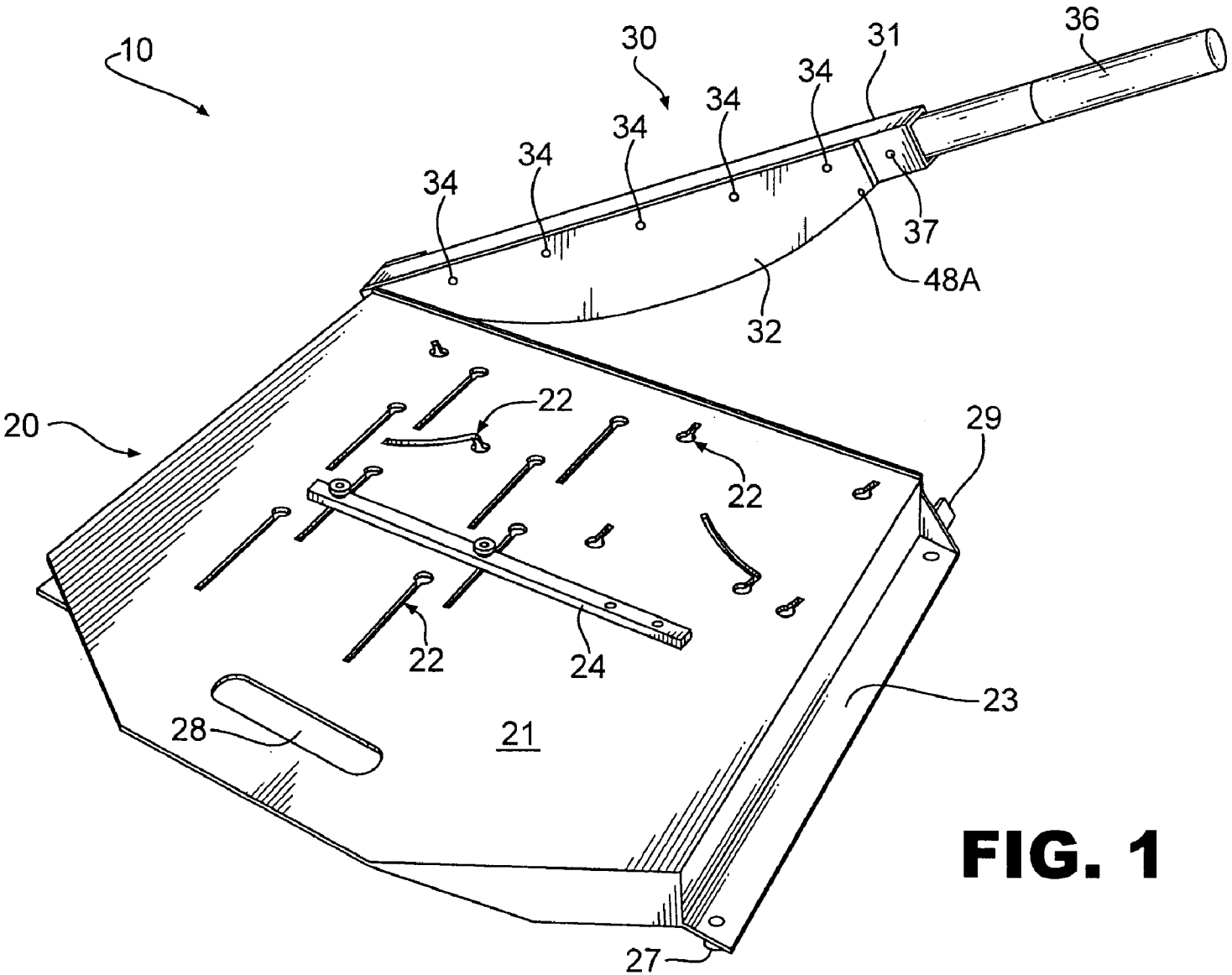
FIG. 1 shows a perspective view of a portable cutting apparatus, in accordance with one embodiment of the subject invention.

An embodiment of a portable cutting apparatus, generally identified by reference numeral 10, is illustrated in the Figures. As shown in FIGS. 1-5, a portable cutting apparatus 10 may comprise a frame assembly 20, a cutting arm assembly 30, and an alignment mechanism 50. The cutting apparatus 10 may be used for cutting roofing shingles, aluminum flashing, paper, and other sheet materials.

Figure 2:
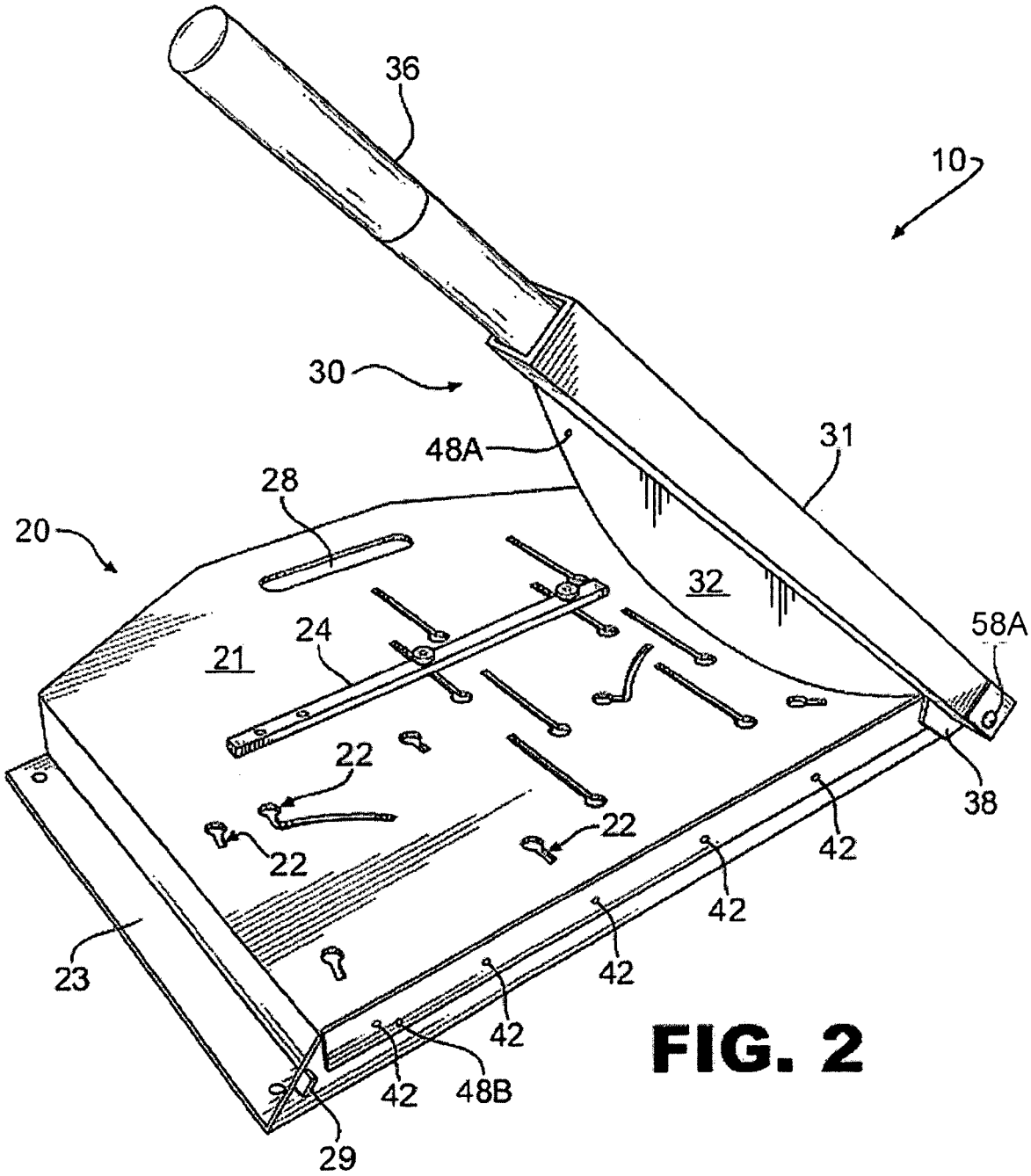
FIG. 2 shows a second perspective view of the portable cutting apparatus of FIG. 1.
Figure 3:
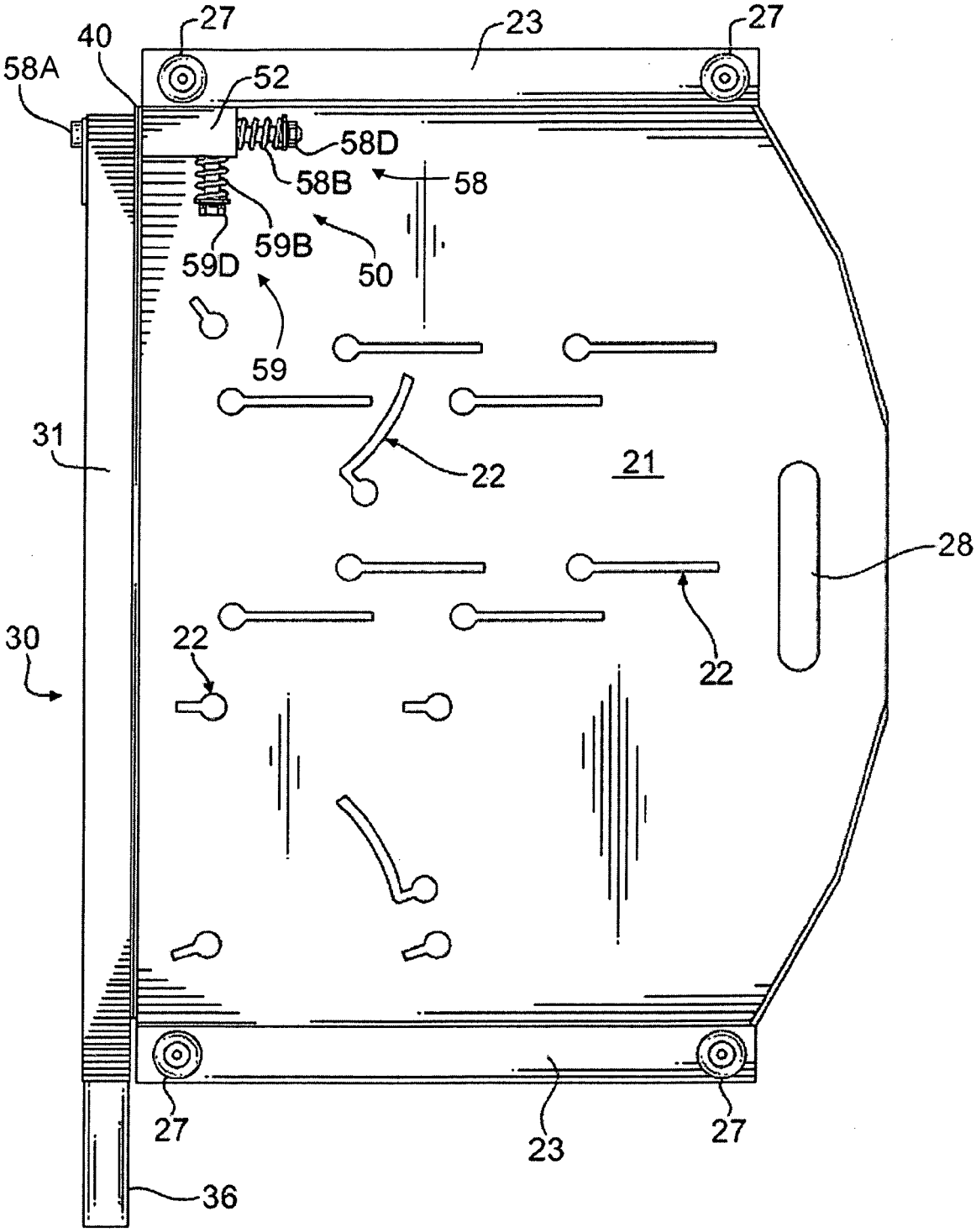
FIG. 3 shows a bottom plan view the portable cutting apparatus of FIG. 1.

As shown in FIGS. 1-3, the frame assembly 20 may comprise a support surface 21, a plurality of reinforcing members 23, a plurality of key holes 22, a selectively adjustable and selectively removable guide fence 24, a plurality of slip-resistant feet 27, a handle aperture 28, and a blade stop tab 29. The frame assembly 20 may be made of aluminum or any other suitable material which may be stamped or machined and subsequently formed.

Figure 4:
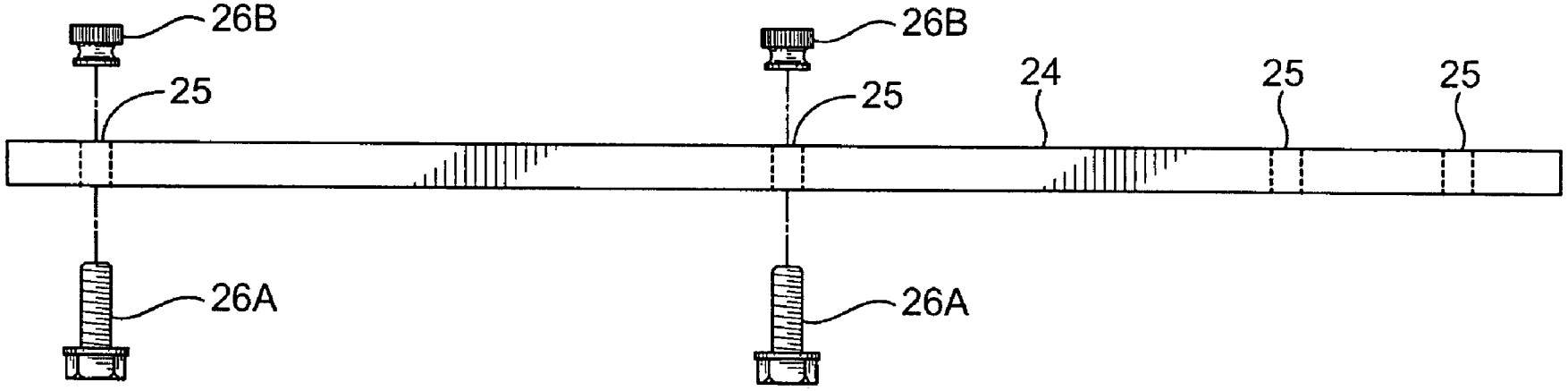
FIG. 4 shows an exploded view of the guide fence and attachment mechanisms.

With continued reference to FIGS. 1-3, a plurality of key holes 22 may be formed at various locations within the support surface 21 to provide a variety of possible alignments of the guide fence 24, depending upon the locations selected during operation. The guide fence 24 may be provided with a plurality of spaced-apart bolt holes 25, as shown in FIG. 4, through which bolts 26A may be inserted. Once the bolt 26A is inserted through the bolt hole 25, a corresponding knurled nut 26B may be threadingly engaged with bolt 26A. When using the guide fence 24 in conjunction with the frame assembly 20, each bolt 26A may be inserted into a key hole 22 selected in accordance with the desired cut length and angle, and positioned such that the bottom of the bolt's head contacts the lower surface of the support surface 21 and the bottom of the guide fence 24 contacts the upper surface of the support surface 21. Once the guide fence 24 is positioned in the selected location, knurled nuts 26B may be tightened by hand such that the guide fence 24 may be secured in a stationary position and may serve as an alignment guide for the material to be sheared by the cutting apparatus 10. The fact that the knurled nuts 26B may be quickly loosened by hand permits rapid removal and/or adjustment of the guide fence 24 to accommodate the requisite orientation of the guide fence 24 during operation.

Figure 6:
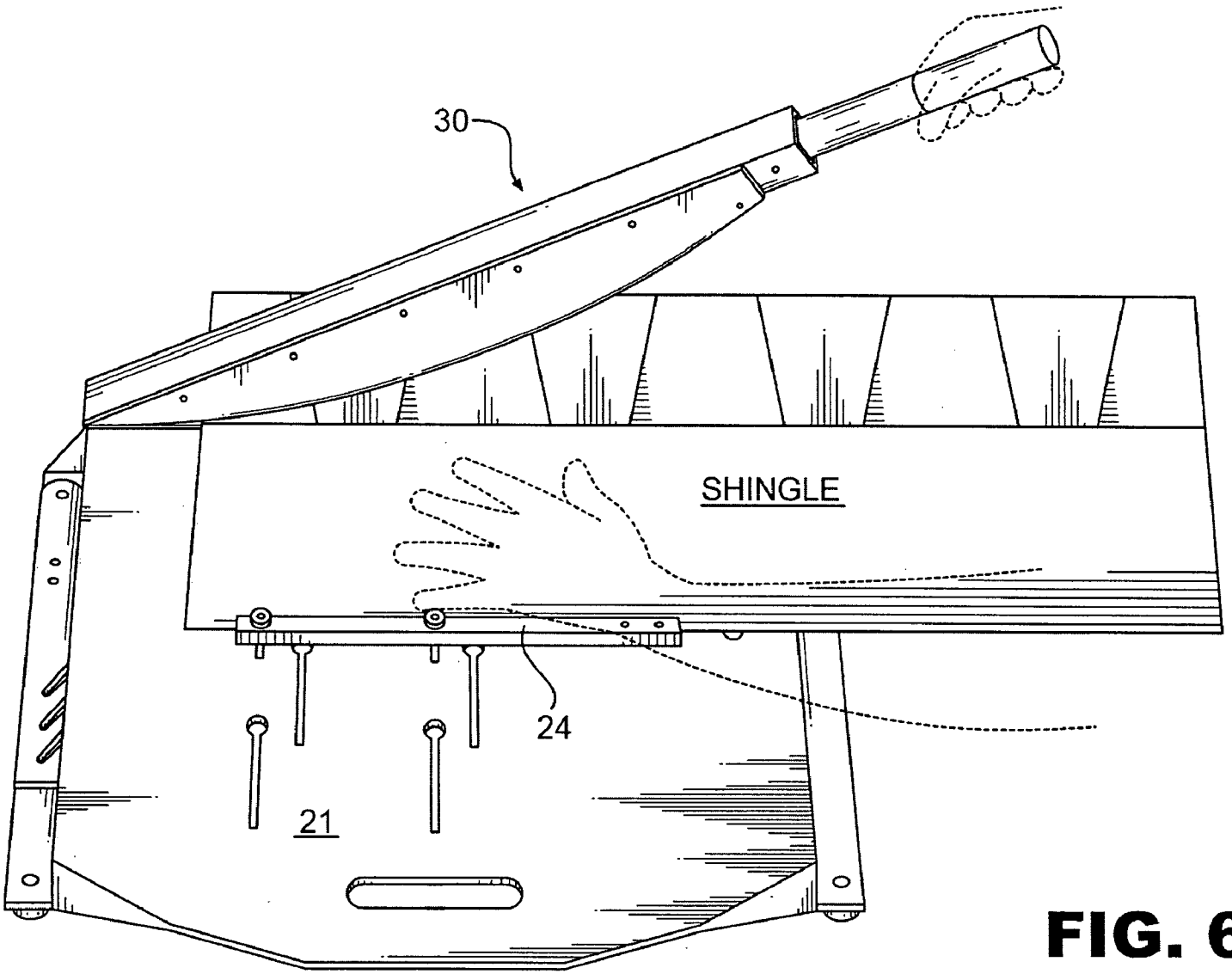
FIG. 6 shows a perspective view of a portable cutting apparatus configured to execute a rip cut.
Figure 7:
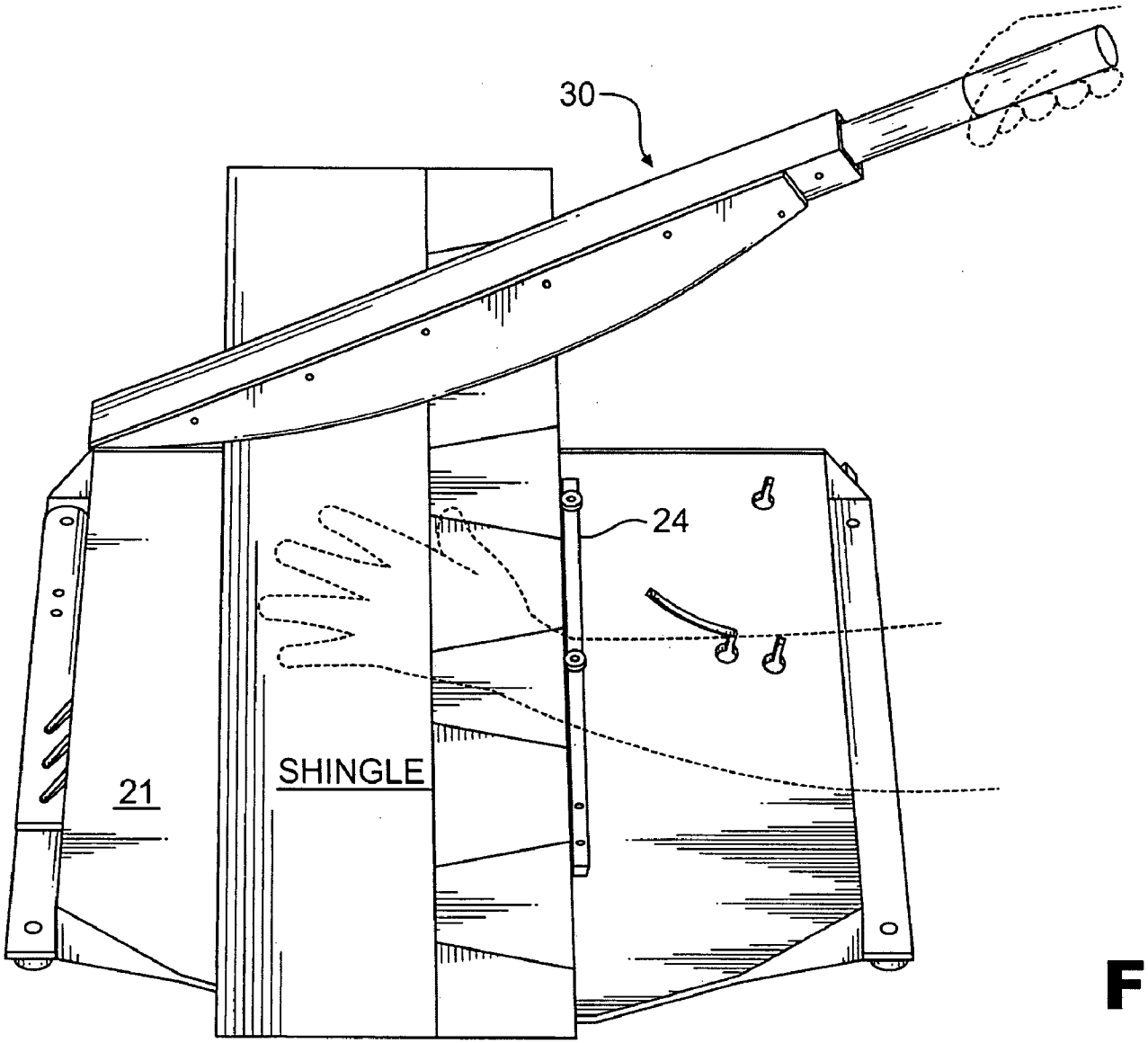
FIG. 7 shows a perspective view of a portable cutting apparatus configured to shear a shingle to a desired length.
Figure 8:
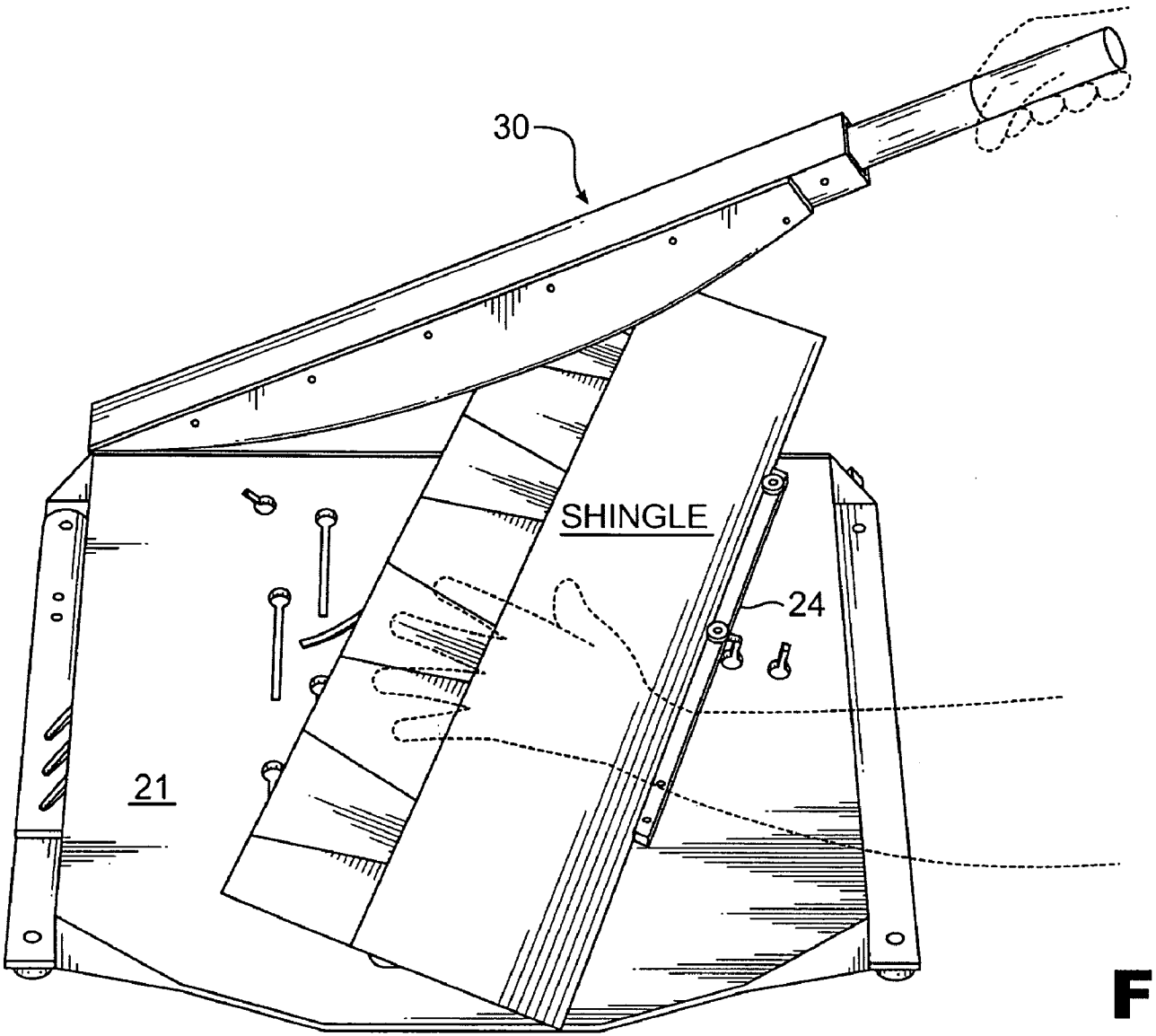
FIG. 8 shows a perspective view of a portable cutting apparatus configured to execute an angled cut.
Figure 9:
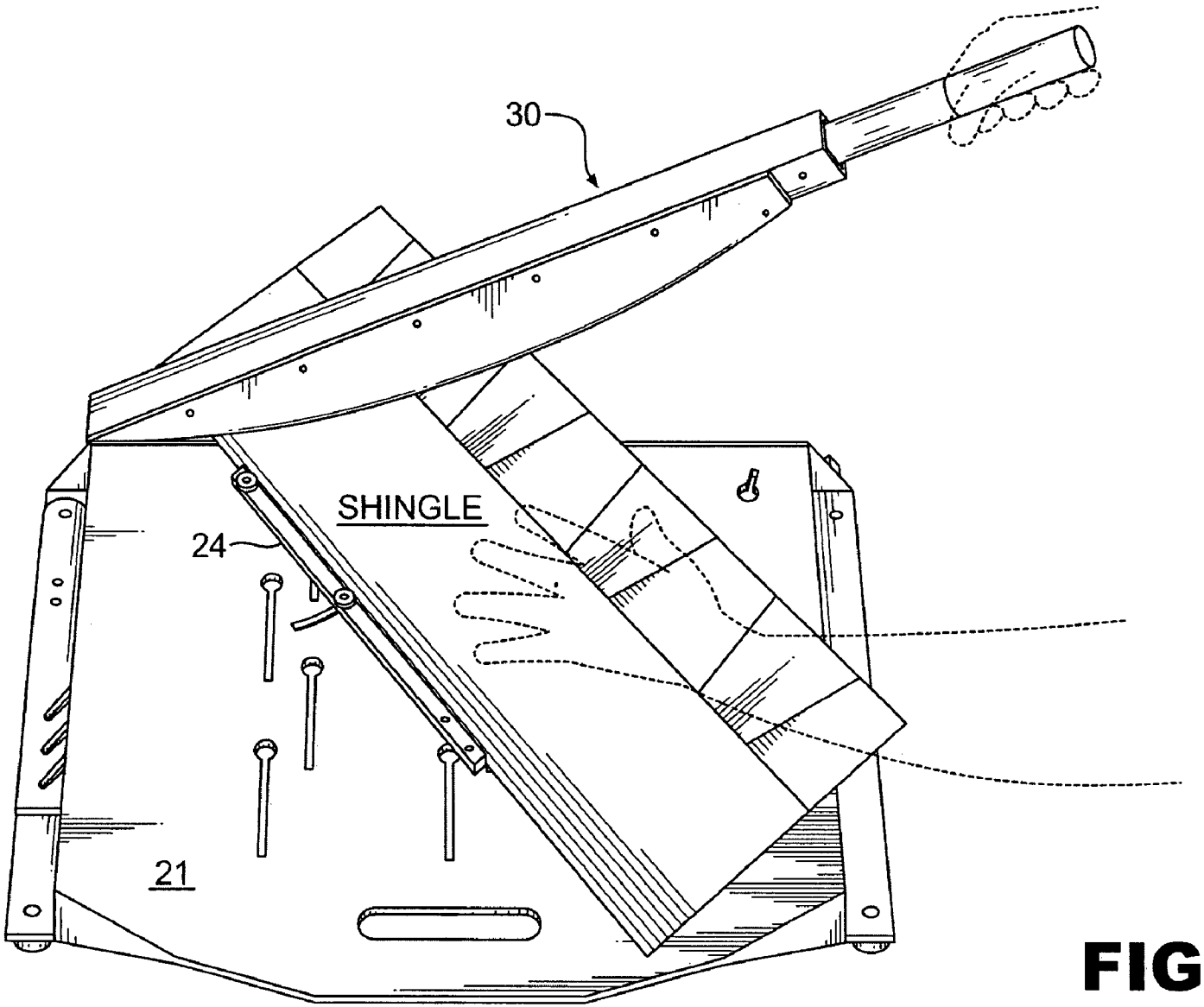
FIG. 9 shows a perspective view of a portable cutting apparatus configured to execute an angled cut.

As shown in FIGS. 1 and 6, the guide fence 24 may be secured in a position parallel to the cutting blade 32 when a "rip" cut, a cut parallel to the length of a shingle, is sought. When performing a "rip" cut, the cutting arm assembly 30 may be raised and a shingle may be placed on the support surface 21 with the portion to be removed from the shingle overhanging the support surface 21 in a position under the arm assembly 30. The arm assembly 30 may be lowered with a force sufficient to cut the shingle more than half way along its length. The arm assembly 30 may be then raised, and the shingle may be advanced in the direction parallel to the cutting blade 32 to a position where the remainder of the shingle may be cut away by a subsequent lowering of the arm assembly 30. Upon completion of the rip cut, the shingle may be advanced further in the direction parallel to the cutting blade 32 to a location where it falls from the cutting apparatus 10 and another shingle may be cut in the same manner as just described. This procedure may be employed when a multiplicity of shingles are to be "ripped" to the same height prior to installation on a roof. The guide fence 24 may also be positioned perpendicularly to the cutting blade 32 when cutting a shingle or other material to a desired length, as shown in FIG. 7. Additionally, the guide fence 24 may be positioned at a plurality of angles required when making hip or valley cuts, as shown in FIGS. 8 and 9. To assist in properly and consistently aligning the guide fence 24, the support surface 21 may be inscribed with numbers indicating angular degrees.

A stationary blade 40 may be selectively attached to the frame assembly 20 by one or more fasteners 42 as are known in the art. The stationary blade 40 may be made of hardened tool steel, however, any suitably hard material may be employed in construction of the stationary blade 40. In the event that the stationary blade 40 becomes dulled through repeated use, the stationary blade 40 may be removed and either replaced or sharpened.

As illustrated in FIGS. 1 and 2, the cutting arm assembly 30 may comprise an arm assembly frame 31, a cutting blade 32 selectively attached to the arm assembly frame 31 by a plurality of fasteners 34, an extendible handle 36, and a blade alignment tab 38 that may be integral with the cutting blade 32. In one embodiment, it is contemplated that the cutting blade 32 may include a arcuate cutting edge. Arcuate is defined to mean bent or curved like a bow; resembling an arch. The extendible handle 36 may be circular in cross-section and insertable into the square cross-section of the arm assembly frame 31. Alternatively, handle 36 may be any of a plurality other shapes, such as rectangular, that may be received within arm assembly frame 31. A set screw 37 or other fasteners may be utilized to secure the extendible handle 36 in the desired position. When cutting thicker materials or materials that require a greater than normal degree of leverage to cut, the set screw 37 may be loosened and the extendible handle 36 may be withdrawn axially to a position providing increased leverage, at which point the set screw 37 may be tightened to again secure the handle 36. As such, the extendible handle 31 may be said to be axially reciprocating within the arm assembly frame 31, that is, the extendible handle 31 may be moved inwardly and outwardly of the arm assembly frame 31.

The cutting blade 32 may be made of tool steel; however, any hard material capable of holding an edge for a period of time may be used in construction of the cutting blade. As a result of repeated use, the cutting blade 32 may become dulled, resulting in diminished shearing ability. In such an event, the plurality of fasteners 34 may be removed from the cutting blade 32, and the cutting blade 32 may be removed, sharpened, and re-secured to the arm assembly frame 31 by the fasteners 34. Alternately, the dulled cutting blade 32 may be replaced by a new cutting blade, which would be fastened to the arm assembly frame 31 in a similar manner as the dulled blade.

Figure 10:
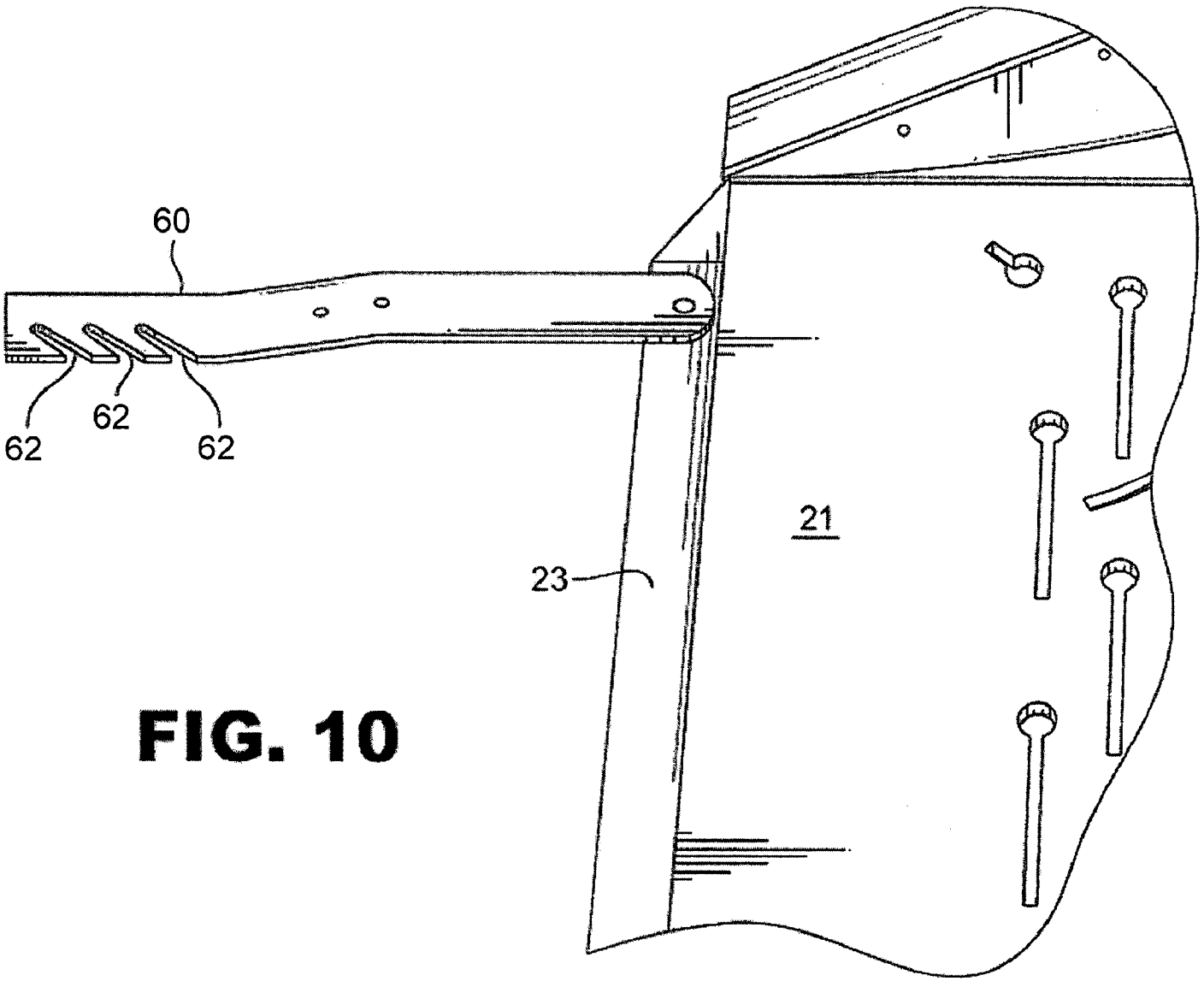
FIG. 10 shows a nailing strap extended from the cutting apparatus.

When transporting the cutting apparatus 10, it may be beneficial to insert the extendible handle 36 axially as deeply into the arm assembly frame 31 as possible in order to reduce the effective perimeter of the cutting apparatus 10 and to decrease the likelihood that the extendible handle 36 will inadvertently contact items in the ambient environment. To prevent the arm assembly 30 from moving while in transit, the arm assembly 30 may be lowered until the bottom of the assembly 30 contacts the top of the blade stop 29, at which point the corresponding blade lock apertures 48A and 48B are aligned. A lock retaining pin (not shown) may be then inserted through both of the apertures 48A, 48B to prevent the arm assembly 30 from being raised unintentionally or inadvertently. Once the cutting apparatus 10 is moved to its operational situs, the retaining pin may be removed and the arm assembly 30 may be raised without interference. In a further embodiment shown in FIG. 10, a retaining member 60 comprising a plurality of notches 62 may be rotatably attached to a reinforcing member 23. In operation, a fastener may be secured to the roofing surface, and a notch 62 may be hooked over the fastener to prevent the cutting apparatus 10 from sliding down the roofing surface. In an alternate embodiment (not shown), a retaining member may comprise one or a plurality of spaced apart apertures through which a nail or other fastener known in the art may be inserted and then fastened to a roof or other slanted surface to inhibit the cutting apparatus 10 from sliding down the slanted surface during operation.

Figure 5A:
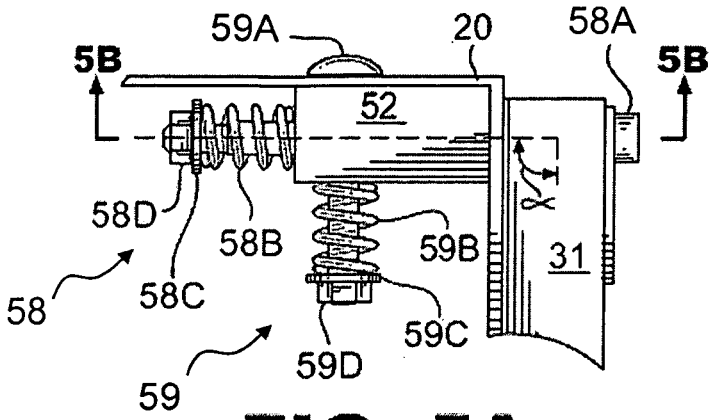
FIG. 5A shows a top plan view of an alignment mechanism with the support surface removed.
Figure 5B:
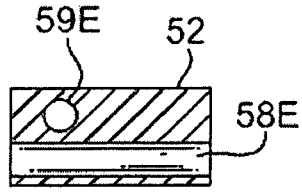
FIG. 5B shows a cross-section of an alignment mechanism block.
Figure 5C:
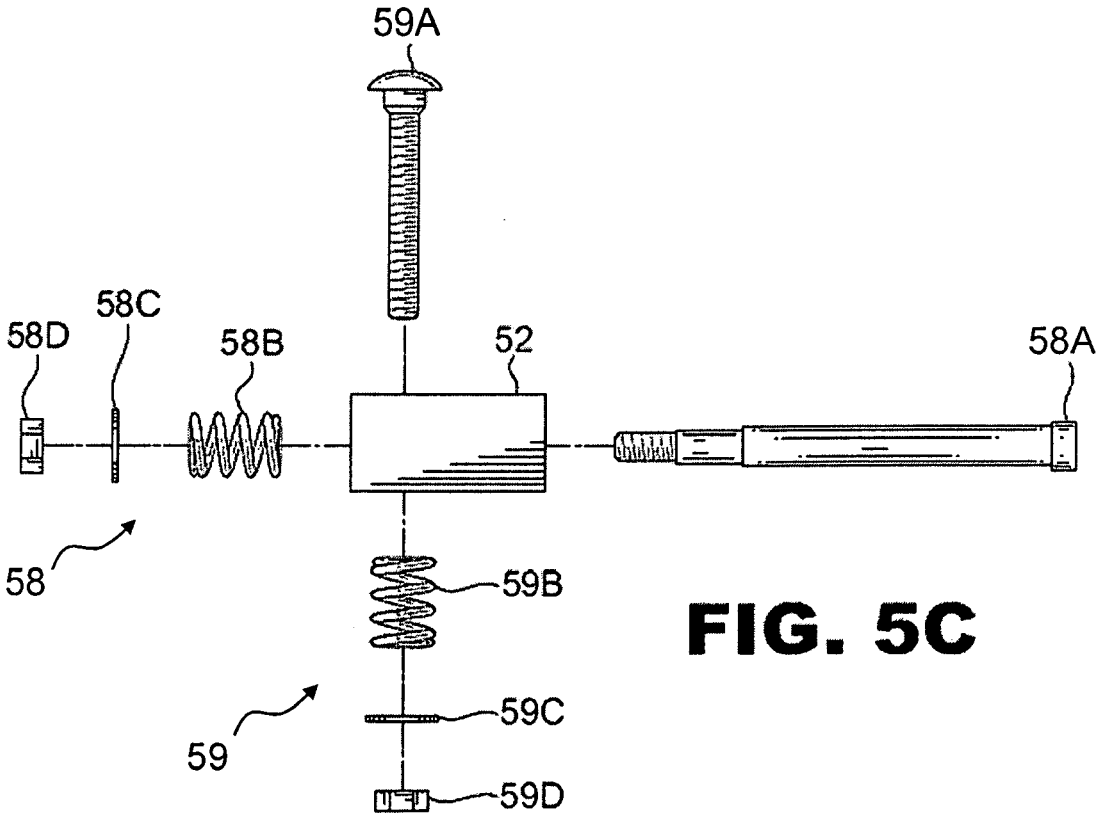
FIG. 5C shows an exploded view of the alignment mechanism of FIG. 5A.

As depicted in FIGS. 3, 5A, and 5C, the arm assembly 30 may be fastened to the frame assembly 20 by the alignment mechanism 50, which may include a plurality of biasing members 58, 59. A first biasing member 58 may include an extended bolt 58A, a spring 58B, a washer 58C, and an extended bolt nut 58D. The extended bolt 58A may be inserted through corresponding apertures in the arm assembly frame 31, the frame assembly 20, the alignment block 52, a spring 58B, and a washer 58C, then threadingly engaged with an extended bolt nut 58D. A second biasing member 59 may include a bolt 59A, a spring 59B, a washer 59C, and a nut 59D. The alignment block 52 may be further secured to the frame assembly 20 by an additional bolt 59A, which may be inserted through corresponding apertures in the frame assembly 20, the alignment block 52, a spring 59B, and a washer 59C, then threadingly engaged with a bolt 59D. As shown in FIG. 5B, the apertures through the alignment block, 58E and 59E, are perpendicular in different vertical planes to ensure there is no interference between extended bolt 58A and bolt 59A during assembly or operation.

In addition to serving as a means for securing the arm assembly 30 to the frame assembly 20, the alignment mechanism 50 maintains the alignment and varies the interference between the cutting blade 32 and the stationary blade 40, permitting the cutting apparatus 10 to shear heavy duty materials such as roofing shingles. In prior art cutting devices, the alignment between the cutting blade and the stationary blade may be altered as a result of repeated use or other unforeseen circumstances. Such improper alignment may lead to deterioration of the quality of the cut edge of a shingle, thereby decreasing the aesthetic appearance of a roof if the poorly sheared shingles are installed. Alternatively, poorly sheared shingles may be discarded and replaced with properly sheared shingles, effectively increasing the material cost of roofing a building. Rather than shearing, loose or improperly aligned cutting devices may also fold the material to be sheared over the edge of the support surface, resulting in undesirably creased (and therefore, unusable) shingles.

Although apertures 58E and 59E are perpendicular, the angle $\alpha$ between extended bolt 58A and bolt 59A may be less than 90°, as extended bolt 58A may be constructed such that the shaft of the bolt is not perpendicular to the head of the bolt. For example, extended bolt 58A may be angled 3°, whereby angle $\alpha$ is 87°, although a range of angles between 75° and 90° is contemplated. To ensure that no difficulties exist when inserting extended bolt 58A through aperture 58E, the diameter of aperture 58E may be greater than the diameter of extended bolt 58A to accommodate the angle of extended bolt 58A. In operation, the angle of extended bolt 58A, in conjunction with extended bolt spring 58B, extended bolt washer 58C, and extended bolt nut 58D, serves to pull cutting blade 32 into proper alignment with stationary blade 40 for cutting. In the event that alignment of the cutting blade 32 and stationary blade 40 may be improper (as evidenced by poor shearing performance or folding of the material to be sheared), the alignment may be altered by either loosening or tightening nut 58D, which in turn decreases or increases the tension in spring 58B. In a similar manner, the alignment may be adjusted by loosening or tightening nut 59D, which similarly increases or decreases the tension in the spring 59B through which bolt 59A has been passed. When viewed as shown in FIG. 3, increasing the tension in either spring 58B or 59B may cause arm assembly 30 to rotate in a counter-clockwise direction toward stationary blade 40.

In an alternate embodiment, extended bolt 58A may be constructed such that the shaft of the bolt and the head of the bolt are perpendicular. In this embodiment, alignment block aperture 58E may be angled through block 52 such that the angle $\alpha$ between the shaft of extended bolt 58A and the shaft of bolt 59A may be less than 90°. For example, the alignment block aperture 58E may be angled such that angle $\alpha$ is 87°, although a range of angles between 75° and 90° is contemplated. Further this embodiment, an axially compressible washer may be inserted between bolt 58A and cutting arm assembly frame 31 to ensure contact between the bottom of the head of the bolt 58A and the cutting arm assembly frame 31.

The foregoing description of the preferred embodiments of the invention is by way of example only, and other variations of the above described embodiments are provided by the subject invention. The embodiments presented herein have been presented for purposes of illustration and are not intended to be exhaustive or limiting. Many variations and modifications are possible in light of the foregoing teaching.

What is claimed is:

1. A cutting apparatus comprising:

a frame assembly including a support surface and a first cutting blade, wherein the support surface includes at least two key holes;

a cutting arm assembly rotatably attached to the frame assembly, the cutting arm including a second cutting blade;

a guide fence selectively attachable to the support surface through the at least two key holes, such that the position of the guide fence corresponds to a cut width and an angular degree; and an alignment mechanism secured to the frame assembly and the cutting arm assembly, wherein the alignment mechanism includes an alignment block, a first biasing member having a first bolt having a first longitudinal axis passing through the alignment block and a first spring with a first adjustable tension, and a second biasing member having a second bolt having a second longitudinal axis passing through the alignment block and a second spring with a second adjustable tension, wherein the first bolt and the second bolt are substantially perpendicular to each other, and further wherein the position of the cutting arm assembly is rotatable relative to the first cutting blade about an axis perpendicular to both the first and second longitudinal axes by adjusting at least one of the first tension, the second tension, or a combination of the first and second tensions.

2. The cutting apparatus of claim 1, wherein the support surface is inscribed with numbers indicating angular degrees relative to the first cutting blade.

3. The cutting apparatus of claim 1, wherein the first cutting blade is selectively attachable to the frame assembly.

4. The cutting apparatus of claim 1, wherein the second cutting blade is selectively attachable to the cutting arm assembly.

5. The cutting apparatus of claim 1, wherein the second cutting blade further comprises a blade alignment tab disposed between the cutting arm assembly and the frame assembly.

6. The cutting apparatus of claim 1, wherein the cutting arm assembly comprises an arm assembly frame and an extendable handle member disposed therein.

7. The cutting apparatus of claim 6, wherein the extendable handle member is axially reciprocating within the arm assembly frame.

8. The cutting apparatus of claim 1, wherein the support surface includes a handle aperture.

9. The cutting apparatus of claim 1, wherein the second cutting blade includes an arcuate cutting edge.

10. A cutting apparatus comprising:

a frame assembly including a support surface having an upper and a lower face and a first cutting blade;

a cutting arm assembly rotatably attached to the frame assembly, the cutting arm including a second cutting blade; and an alignment mechanism secured to the frame assembly and the cutting arm assembly, wherein the alignment mechanism includes an alignment block, a first biasing member having a first bolt having a first longitudinal axis passing through the alignment block and a first spring with a first adjustable tension, and a second biasing member having a second bolt having a second longitudinal axis passing through the alignment block and a second spring with a second adjustable tension, wherein the alignment mechanism is located within an outer perimeter of and beneath the lower face of the support surface, wherein the first bolt and the second bolt are substantially perpendicular to each other, and further where in the position of the cutting arm assembly is rotatable relative to the first cutting blade about an axis perpendicular to both the first and second longitudinal axes by adjusting at least one of the first tension, the second tension, or a combination of the first and second tensions.

11. The cutting apparatus of claim 10, wherein the first biasing member is positioned substantially perpendicular to the first cutting blade and the second biasing member is positioned substantially parallel to the first cutting blade.

12. The cutting apparatus of claim 10, wherein the angle between a shaft of the first bolt and the first cutting blade is less than 90°.

13. The cutting apparatus of claim 12, wherein the angle between the shaft of the first bolt and the first cutting blade is between 75° and 90°.

14. A cutting apparatus comprising:

a frame assembly including a support surface having an upper and a lower face and a first cutting blade, wherein the support surface includes at least one key hole;

a cutting arm assembly rotatably attached to the frame assembly, the cutting arm including a second cutting blade; and an alignment mechanism secured to the frame assembly and the cutting arm assembly, wherein the alignment mechanism includes an alignment block, a first biasing member having a first bolt having a first longitudinal axis passing through the alignment block and a first spring with a first adjustable tension, and a second biasing member having a second bolt having a second longitudinal axis passing through the alignment block and a second spring with a second adjustable tension, wherein the alignment mechanism is located within an outer perimeter of and beneath the lower face of the support surface, wherein the first bolt and the second bolt are substantially perpendicular to each other, and further where in the position of the cutting arm assembly is rotatable relative to the first cutting blade about an axis perpendicular to both the first and second longitudinal axes by adjusting at least one of the first tension, the second tension, or a combination of the first and second tensions.

15. The cutting apparatus of claim 14, wherein the first biasing member is positioned substantially perpendicular to the first cutting blade and the second biasing member is positioned substantially parallel to the first cutting blade.

16. The cutting apparatus of claim 14, further comprising a guide fence selectively attachable to the support surface through the at least one key hole, such that the position of the guide fence corresponds to an angle relative to the first cutting blade.

17. The cutting apparatus of claim 14, wherein the second cutting blade includes an arcuate cutting edge.

* * * * *